US011044540B2

(12) United States Patent
D'Ascanio et al.

(10) Patent No.: US 11,044,540 B2
(45) Date of Patent: Jun. 22, 2021

(54) AUDIO SPEAKER

(71) Applicants: Franco L. D'Ascanio, Key Colony Beach, FL (US); Franco C. D'Ascanio, Key Colony Beach, FL (US); Sean P. Snowden, Marathon, FL (US)

(72) Inventors: Franco L. D'Ascanio, Key Colony Beach, FL (US); Franco C. D'Ascanio, Key Colony Beach, FL (US); Sean P. Snowden, Marathon, FL (US)

(73) Assignee: COASTAL SOURCE, LLC, Marathon, FL (US)

( * ) Notice: Subject to any disclaimer, the term of this patent is extended or adjusted under 35 U.S.C. 154(b) by 95 days.

(21) Appl. No.: 16/578,558

(22) Filed: Sep. 23, 2019

(65) Prior Publication Data

US 2020/0100007 A1 Mar. 26, 2020

Related U.S. Application Data

(60) Provisional application No. 62/736,165, filed on Sep. 25, 2018.

(51) Int. Cl.
*H04R 1/02* (2006.01)

(52) U.S. Cl.
CPC ..... *H04R 1/025* (2013.01)

(58) Field of Classification Search
CPC ..... H04R 2201/403
See application file for complete search history.

(56) References Cited

U.S. PATENT DOCUMENTS

| | | | | |
|---|---|---|---|---|
| 4,884,655 | A * | 12/1989 | Freadman | H04R 1/26 181/145 |
| 10,356,497 | B1 * | 7/2019 | Brown | H04R 1/04 |
| 2005/0058314 | A1 * | 3/2005 | Lee | H04R 1/026 381/335 |
| 2007/0110269 | A1 * | 5/2007 | Levitsky | H04R 1/403 381/335 |
| 2009/0196450 | A1 * | 8/2009 | Hughes | H04R 1/2819 381/334 |
| 2015/0010194 | A1 * | 1/2015 | Rodgers | H04R 1/023 381/391 |
| 2015/0289037 | A1 * | 10/2015 | Kutil | H04R 1/403 381/387 |
| 2017/0295418 | A1 * | 10/2017 | Curtinsmith | H04R 1/20 |
| 2017/0353786 | A1 * | 12/2017 | Button | H04R 1/26 |
| 2020/0100006 | A1 * | 3/2020 | D'Ascanio | H04R 5/02 |
| 2020/0196037 | A1 * | 6/2020 | Howard | H04R 1/023 |

FOREIGN PATENT DOCUMENTS

CN 104954901 A * 9/2015

* cited by examiner

*Primary Examiner* — Fan S Tsang
*Assistant Examiner* — Angelica M McKinney
(74) *Attorney, Agent, or Firm* — Stuart M. Goldstein

(57) ABSTRACT

A variable waveguide speaker controls, narrows, and directs the dispersion of the lower driver array to handle far-field listening areas. The widening mid-section of the speaker directs the sound from the mid-driver array to mid-field listening areas. The top of the speaker is the widest, allowing the top array drivers to cover their widest dispersion for near-field listening areas. This form-follows-function design results in a modern shape and elegant enclosure, as well as superior audio performance. A unique laminar flow grill system consisting of a multi-layer sandwich arrangement protects the speaker components from performance damage UV rays, dust, debris, water and ice.

10 Claims, 3 Drawing Sheets

AUDIO SPEAKER

RELATED APPLICATION

The application claims the benefit of provisional application, Ser. No. 62/736,165, filed on Sep. 25, 2018.

BACKGROUND OF THE INVENTION

Variable waveguide and line array drivers are designed to complement each other in order to produce constant coverage. Typical ground plane line arrays can cover long distances well, but can suffer from very narrow vertical dispersion, which greatly diminishes sound performance in the near field listening area. There is currently no waveguide audio speaker which provides full sounds in the near field, intermediate field, and far field listening areas.

SUMMARY OF THE INVENTION

It is thus the object of the present invention to provide an waveguide speaker system which addresses the disadvantages and limitations of existing systems.

This object is accomplished by the present invention, a variable waveguide speaker which controls, narrows, and directs the dispersion of the lower driver array to handle far-field listening areas. The widening mid-section of the speaker directs the sound from the mid-driver array to mid-field listening areas. The top of the speaker is the widest, allowing the top array drivers to cover their widest dispersion for near-field listening areas. This form-follows-function design results in a modern shape and elegant enclosure, as well as superior audio performance. A unique laminar flow grill system consisting of a multi-layer sandwich arrangement protects the speaker components from performance damage UV rays, dust, debris, water and ice.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Ground plane audio speaker 1 of the present invention takes full advantage of the first weather-resistant ribbon tweeter technology for high SPL & fidelity over long throw distances.

Figure 1:
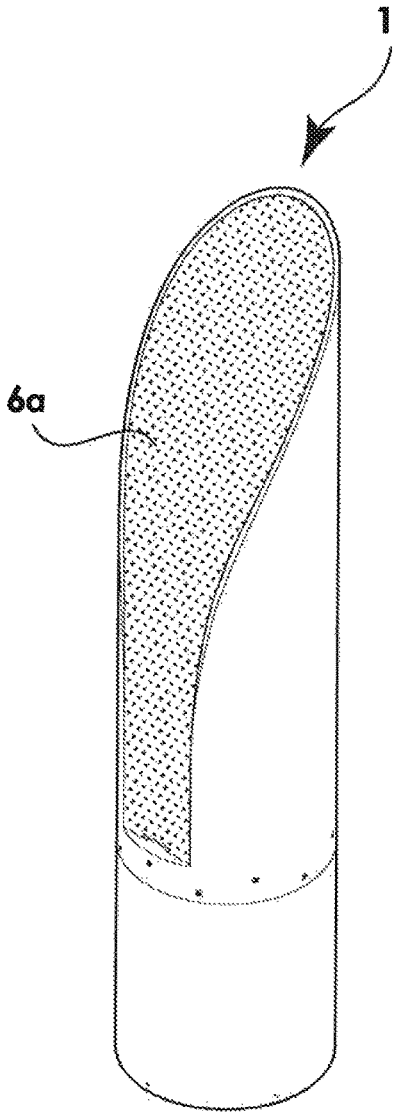
FIG. 1 shows a front perspective view of the audio speaker of the present invention.
Figure 2:
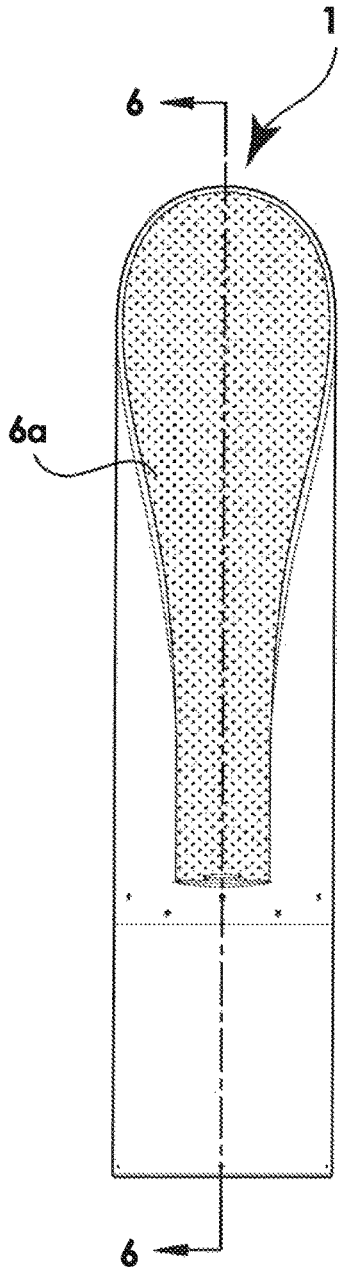
FIG. 2 shows a front view of the audio speaker of the present invention.
Figure 3:
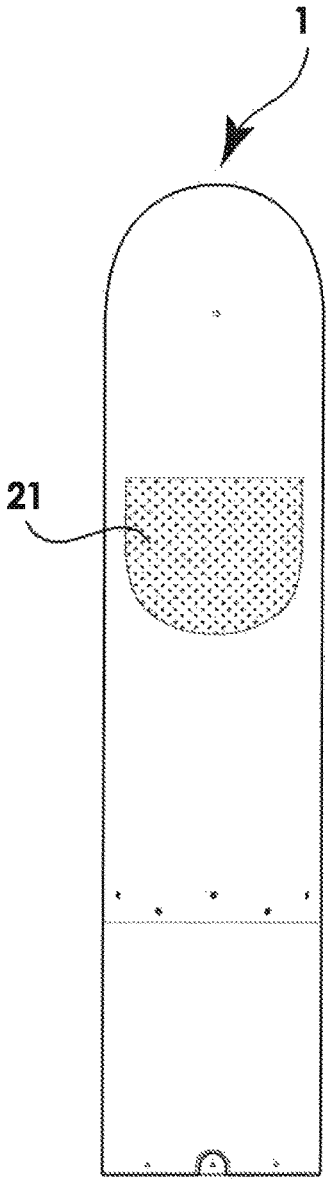
FIG. 3 shows a rear view of the audio speaker of the present invention.
Figure 4:
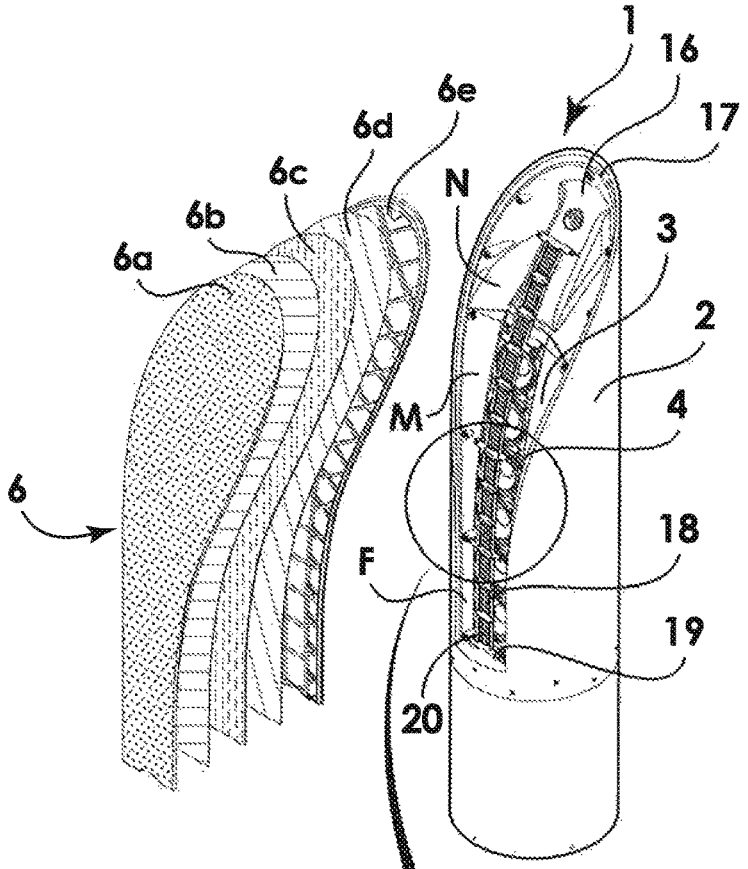
FIG. 4 is a front perspective of the audio speaker of the present invention, illustrating an exploded view of the components of the laminar flow grill system and speaker interior components.
Figure 5:
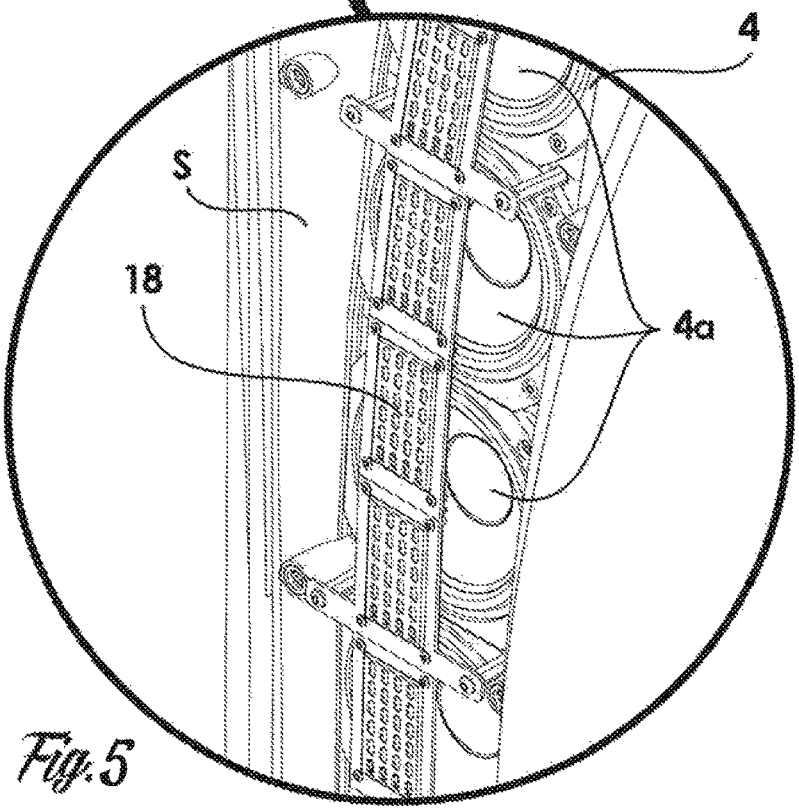
FIG. 5 is a view of the audio speaker of the present invention taken from FIG. 4.
Figure 6:
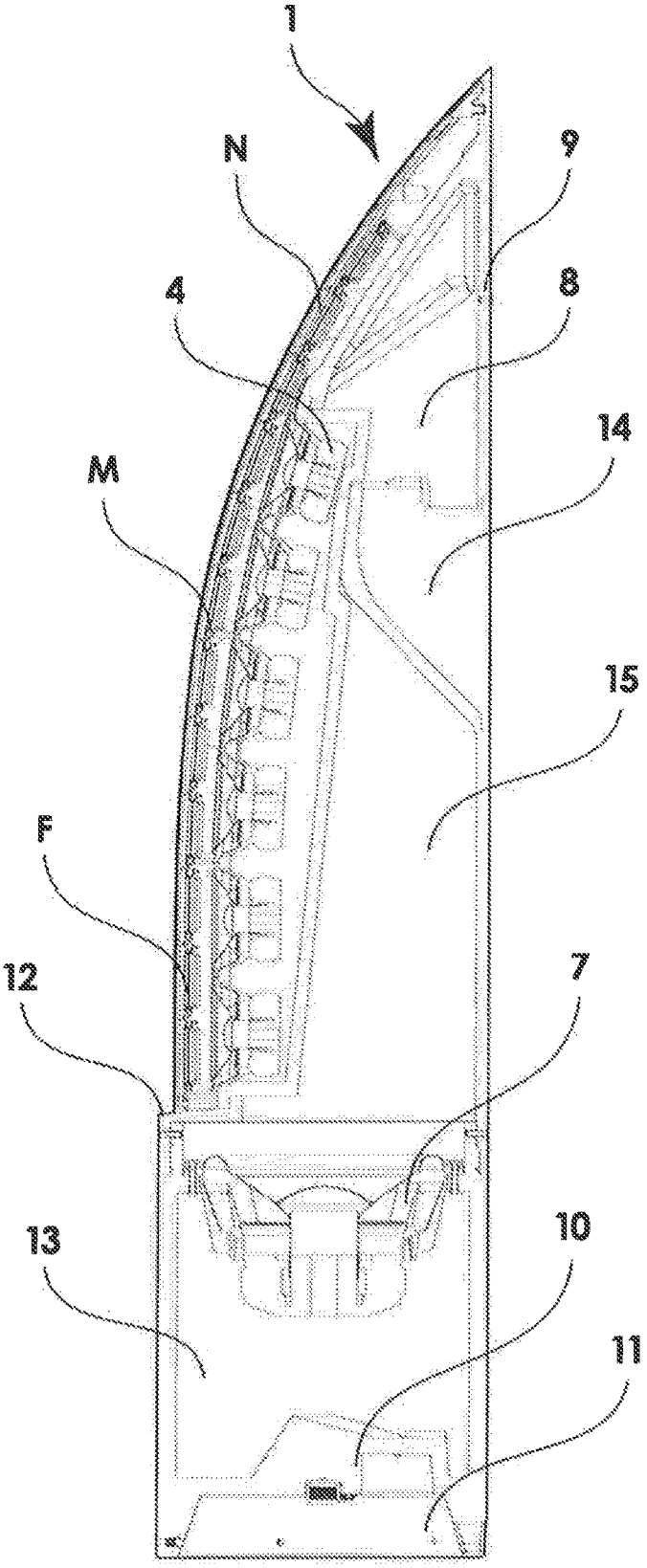
FIG. 6 is a section view of the audio speaker of the present invention, taken from FIG. 2.

Form follows function in this beautiful design comprising housing 2 with front opening 3. Front opening 3 is configured such that it is circular at the top where it is the widest, then tapers smoothly down to the bottom, where it is the narrowest. See FIG. 1. Internal space S is located within housing 2, through front opening 3. Speaker array 4 comprising vertically aligned speaker components 4*a*, are curvilinearly mounted within internal space S of speaker 1.

Tweeter bridge support 16 at upper region 17 of speaker 1, secures the top of curvilinear ribbon tweeter array 18 over speaker array 4. Ribbon tweeter array 18 is secured at its bottom 19 by array bracket 20.

This design results in a variable waveguide technology which further enhances typical line array performance with constant coverage of near-field 4' to 12', N, mid-field 12' to 36', M, and far-field 36' to 100', F, listening areas. An integrated, high-power, fourth order, built-in bandpass subwoofer 7 fills out the full frequency range. No other audio speaker can properly provide the full range of coverage with the power and fidelity of the audio speaker of the invention.

Speaker 1 also features a unique laminar flow grill system 6 comprising a multi-layer sandwich grill system to protect the drivers from performance damaging UV rays, water, dust, impurities, corrosion, and to keep water and ice from collecting in the up-firing speakers. Grill system 6 is built with an outer external perforated grill 6*a* which rejects particulate debris. The internal layers include weather-resistant fabric 6*b*, reticulated foam 6*c* and hydrophobic cloth 6*d* to channel water down to drain. The back is a secondary, internal perforated grill 6*e* for support. Laminar flow grill system 6 acts as a filter by rejecting large and small particulates along with capturing water and draining it away from the working components of the speaker system.

Built-in bandpass subwoofer 7 is integrated into speaker driver compartment 13. Air trap 8 located above subwoofer port 14 prevents rising water from entering subwoofer chamber 15. Removable plug 9 allows water drainage when mounted upside-down. Support grill 21 is provided on the back side of speaker 1.

Speaker 1 is powered via a 4-channel plug and play input/output cabling system 10. This tri-amped system (with optional external subwoofer) operates using a single cable that connects all four discrete channels (left channel, right channel, integrated subwoofer, and external subwoofer) through a plug and play connection. This connection system allows the installer to make connections effortlessly without concern of polarity, the number of speakers being connected, or their order of installation. It is virtually impossible to short the cables or connect the speakers to the incorrect channel.

Speaker 1 is adaptable for both indoor and outdoor environments. Recessed hardscape bracket 11 allows for the upright, inverted, or dual mounting of speaker 1 for outdoor installation. Lighting is made possible via an optional LED module 12 that can provide ambient or task lighting.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An audio speaker comprising:

an outer housing having a front opening with curved outer edges which taper smoothly down from a circular top edge to a bottom edge, such that it is widest at the top edge and narrowest at the bottom edge, said front opening leading into an internal space;

an array of speaker components vertically aligned and curvilinearly mounted within the internal space, said array extending continuously up from the bottom edge of the opening and terminating below the circular top edge of the opening;

a curvilinear ribbon tweeter array located over the array of speaker components and extending continuously up from the bottom edge of the opening and terminating above the array of speaker components, wherein the area of the tweeter array above the array of speaker components comprises constant coverage of near-field listening areas; and a curvilinear laminar flow grill system extending over the ribbon tweeter array.

2. The audio speaker as in claim 1 wherein the laminar flow grill system comprises a multi-layer, sandwich grill system.

3. The audio speaker as in claim 2 wherein the sandwich grill system comprises an internal layer of weather-resistant fabric, an internal layer of reticulated foam, and an internal layer of hydrophobic cloth.

4. The audio speaker as in claim 3 wherein the sandwich grill system further comprises an external perforated grill and an internal perforated grill.

5. The audio speaker as in claim 1 wherein the laminar flow grill system has the same narrowing configuration as the front opening.

6. The audio speaker as in claim 4 wherein the laminar flow grill system has the same narrowing configuration as the front opening.

7. The audio speaker as in claim 1 further comprising a sub-woofer speaker component located in a chamber below the array of speaker components.

8. The audio speaker as in claim 7 further comprising an air trap to prevent water from entering the chamber.

9. An audio speaker comprising:

an outer housing having an internal space;

an array of speaker components vertically aligned and curvilinearly mounted within the internal space; and curvilinear laminar flow grill means extending over the curvilinear array of speaker components for protecting the speaker components from UV rays, dirt, particulate debris, dust, corrosion, water and ice, said grill means comprising a multi-layer, sandwich grill system having an external perforated grill, an internal layer of weather-resistant fabric, an internal layer of reticulated foam, and an internal layer of hydrophobic cloth.

10. The audio speaker as in claim 9 wherein the sandwich grill system further comprises an external perforated grill and an internal perforated grill.

* * * * *